US005951205A

United States Patent [19]

Chen

[11] Patent Number: 5,951,205

[45] Date of Patent: Sep. 14, 1999

[54] AMPHIBIOUS AUDIBLE ALARM DEVICE

[76] Inventor: Frankie Chen, 4F, No. 20, Ln. 46, Shin-Tung Rd., Taipei, Taiwan

[21] Appl. No.: 08/893,846

[22] Filed: Jul. 11, 1997

[51] Int. Cl.[6] ..... B63C 11/26

[52] U.S. Cl. ..... 405/186; 116/27; 181/120; 441/89

[58] Field of Search ..... 405/186; 181/120, 181/113; 116/137 A, 27, 26, 112; 367/143, 142, 144, 174, 910; 441/131

[56] References Cited

U.S. PATENT DOCUMENTS

| | | | |
|---|---|---|---|
| 3,277,437 | 10/1966 | Bouyoucos | 181/120 |
| 3,433,202 | 3/1969 | Sharp et al. | 116/27 |
| 4,095,667 | 6/1978 | Mahig et al. | 181/120 |
| 5,106,236 | 4/1992 | Hancock et al. | 405/186 |
| 5,302,055 | 4/1994 | Johnston | 405/186 |

*Primary Examiner*—Dennis L. Taylor
*Attorney, Agent, or Firm*—W. Wayne Liauh

[57] ABSTRACT

An amphibious audible alarm device for a diver to use with an air tank in the water or above water surface in the event of incident or emergency to get other people's attention. The device includes a valve member connecting with the air tank for controlling compressed air flow, a noise making mechanism includes a piston reciprocally movable within a cylinder because of compressed air and an impact member to receive the impact of the piston to produce audible sound, and a body to house the valve member and the noise making mechanism. The device can work equally well in the water or in the atmosphere. It is compact size, simply structured, easy to carry and use.

9 Claims, 4 Drawing Sheets

AMPHIBIOUS AUDIBLE ALARM DEVICE

BACKGROUND OF THE INVENTION

1. Field of the Invention

This invention relates to an audible signaling apparatus and particularly to an audible alarm device which is workable both in the water and in the atmosphere.

2. Description of the Prior Art

Diving has become a popular recreational activity and sport in recent years. However it is also an activity with relating high risk comparing with other sports. An unforeseen incident or an emergency could happen to any diver in the water. A diver therefore has to get other people's attention or to seek help instantly whenever a risking situation arisen. A delay of getting other people's attention or help could result in a diver's injury or even death.

In order to protect a diver from the potential risk, there are safeguard devices being developed. U.S. Pat. No. 5,106,236 (Hancock et al.) is one of the examples. It is an audible alarm device for divers. It includes a horn bell and a diaphragm housed in a noisemaker portion. The diver's air tank provides compressed air to trigger the horn bell and the diaphragm to generate audible alarm when in use. However, it can only function in the atmosphere above water surface. It cannot function in the water when the noisemaker portion has water in it. It is therefore useless when the diver is in the water and below water surface.

SUMMARY OF THE INVENTION

In view of aforesaid disadvantage, it is therefore an object of this invention to provide an amphibians audible alarm device which can function both in the atmosphere and in the water. It is therefore more effective and useful.

It is another object of this invention to provide an audible alarm device which is small size, simple structure and easy to carry and use.

The amphibious audible alarm device according to this invention includes a valve means connecting to an air tank for controlling the flow of compressed air, a noise making means to receive compressed air and to generate audible alarm and a body to house the valve means and the noise making means. The noise making means includes a cylinder, a piston and an impact member, compressed air triggers the piston to move reciprocally in the cylinder and to hit the impact member for producing audible alarm. It can function equally well in the air or in the water.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENT

Figure 1:
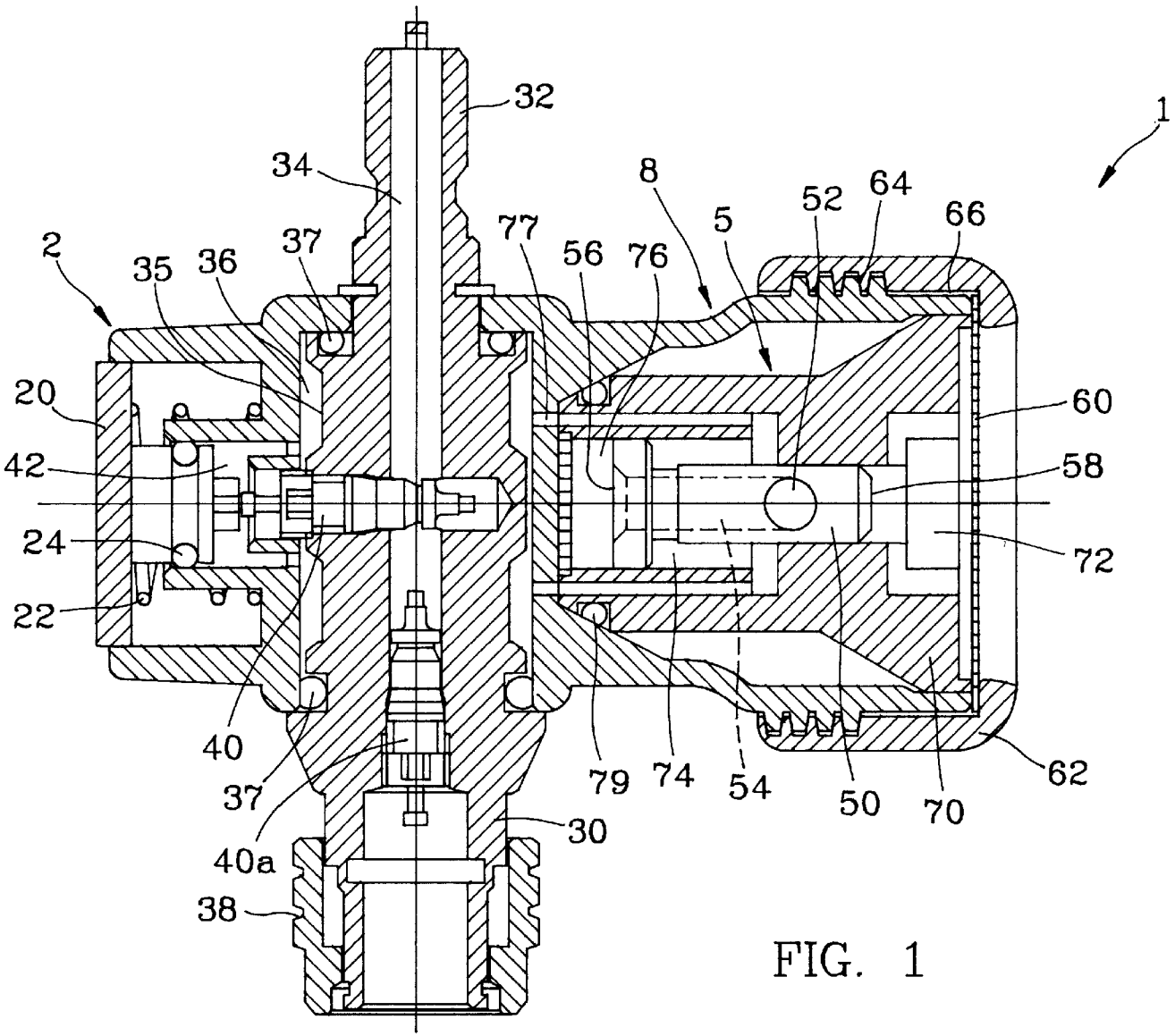
FIG. 1 is a sectional view of this invention.

Referring to FIG. 1, an amphibious audible alarm device 1 according to this invention includes a valve means 2, a noise making means 5 and a body 8 which houses the valve means 2 and the noise making means 5.

The valve means 2 includes a button 20, a stem 30 and a first valve 40. The stem 30 is substantially a cylindrical tube with an internal passage 34 running axially throughout it. The stem 30 is located about in the middle portion of the body 8 and extends on two opposite sides thereof. There are a plural number of grooves 35 formed on the peripheral surface of the stem 30 to serve as a compressed air flow path 36. One end (on the top) of the stem 30 serves as a connector 32 (may be a snap male connector) for engaging with an air tank which usually used by a scuba diver. Another end (at the bottom) of the stem 30 may be a female connector 38 with a second valve 40*a* located therein for engaging with other diving gears.

The first valve 40 is located in the middle portion of the stem 30 for controlling fluid communication between the internal passage 34 and the air flow path 36. At one end of the first valve 40 is a button 20 engageable with one end of the body 8 through a resilient member 22 such as a spring. Between the first valve 40 and the button 20, there is a fluid passage 42 communicating with the air flow path 36. Upon pressing the button 20, the first valve 40 will be opened to allow compressed air flowing from the internal passage 34 to the air flow path 36 via the first valve 40 and the fluid passage 42. When external force is absent, the resilient member 22 will keep the first valve 40 in a closed state. There is a first O-ring 24 disposed between the first valve 40 and the body 8, and a pair of second O-ring 37 located at an upper and a lower junctures between the stem 30 and the body 8 to avoid compressed air leakage.

The noise making means 5 is located at a front end of the body 8. It includes a piston 50, an impact member 60 and a cylinder 70. The piston 50 is a substantially T-shape member with a radial bore 52 in its stem. An axial bore 54 is formed between the rear end of piston 50 and the radial bore 52. The piston 50 is reciprocally movable within the cylinder 70. The impact member 60 preferably made by a metal sheet is secured at a front end of the cylinder 70 by a cap 62 which has threads 64 to engage with the body 8. There is a gap 66 between the cap 62, threads 64 and the body 8 for allowing air to discharge outside from the cylinder 70 via an air discharging chamber 72 located between the front end of the cylinder 70 and the impact member 60.

The inside space of the cylinder 70 may be divided into three partitions depending on the position of the piston 50, i.e., the air discharging chamber 72 in the front, a rear chamber 76 behind the piston 50 and a front chamber 74 in the middle portion. The piston 50 is moving air-tight within the cylinder 70, therefore the chambers 72, 74 and 76 do not fluidly communicate with each other directly. Furthermore there is a third O-ring 79 between the cylinder 70 and the body 8 for preventing air leakage.

In a rear portion of the cylinder 70, there is a pair of air channels 77 communicating with the air flow path 36 in the rear and the front chamber 74 at the front.

Figure 2:
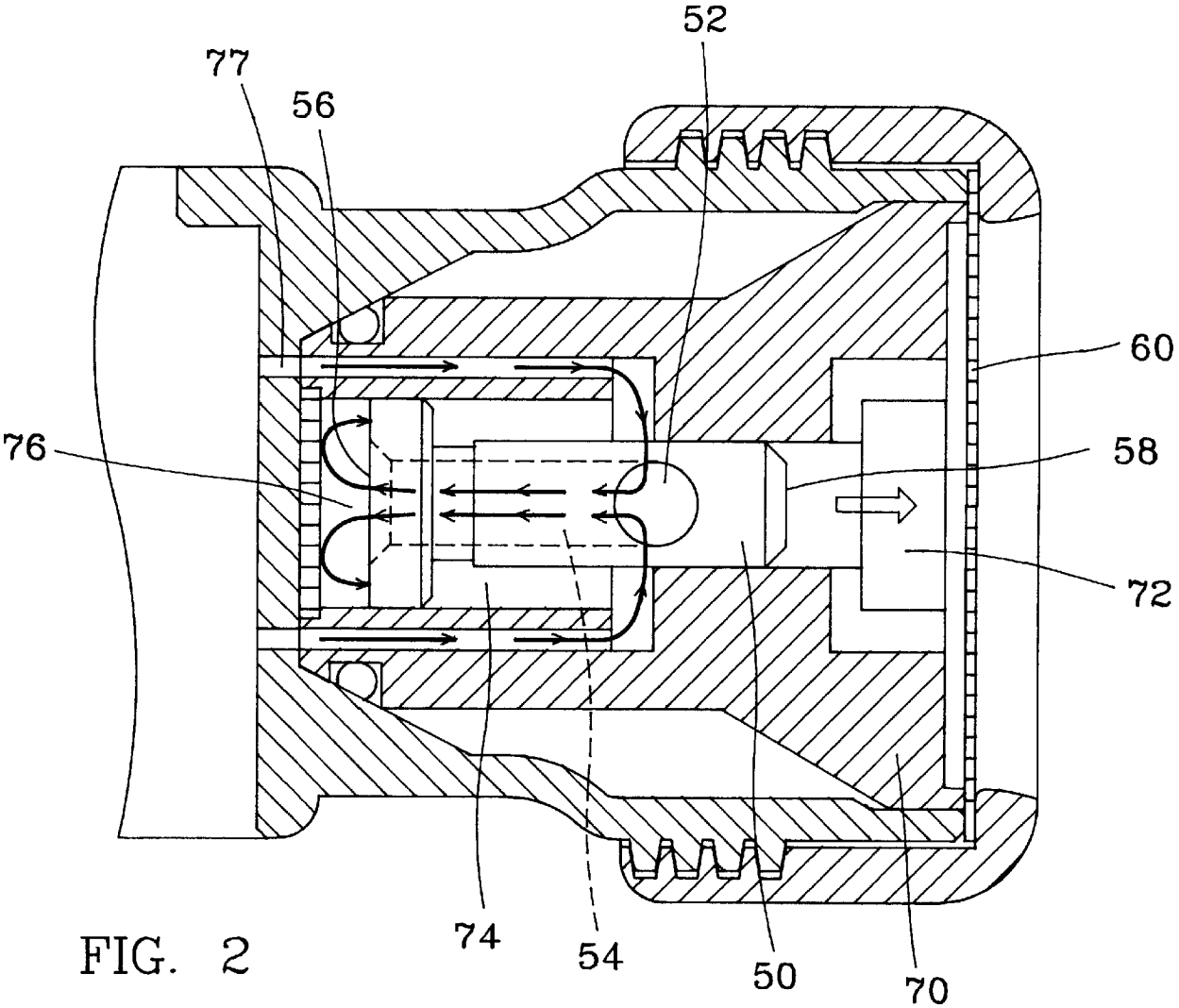
FIG. 2 is a sectional view of a piston in motion (at a first position)

Referring to FIG. 2, when in use, compressed air can flow from the air flow path 36 via the air channel 77, radial bore 52 and axial bore 54 into the rear chamber 76 to apply air pressure on the rear end of the piston 50, and thus moves the piston 50 forward. The front end 58 of the piston 50 will hit the impact member 60 for generating audible noise.

Figure 3:
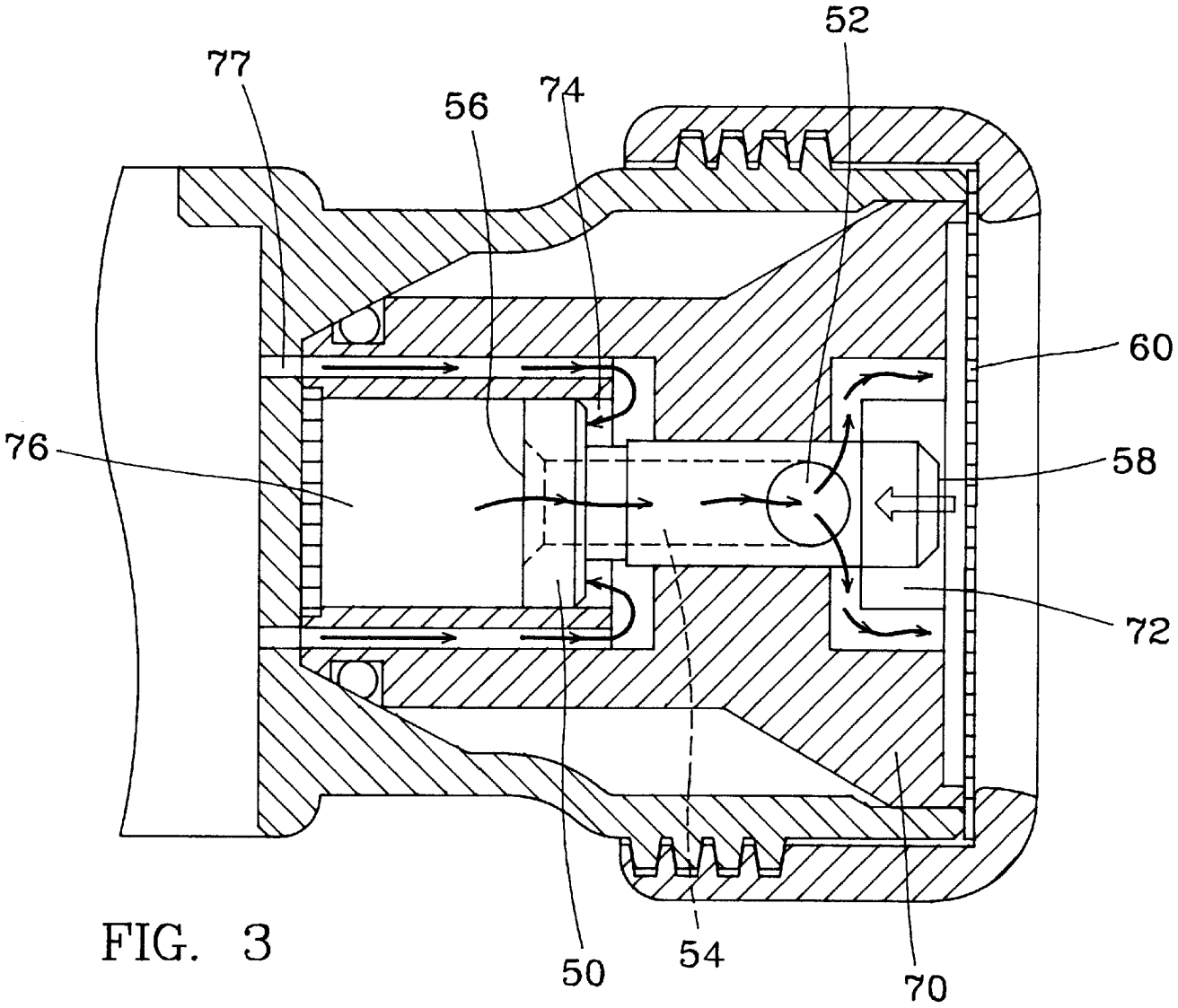
FIG. 3 is another sectional view of a piston in motion (at a second position).

Referring to FIG. 3, when the piston 50 is moved to the front end of the cylinder 70, the radial bore 52 aligns the discharging chamber 72 such that the compressed air in the rear chamber 76 passes to the discharging chamber 72 through the axial bore 54 and the radial bore 52 and is discharged to the outside environment via the gap 66. Therefore the air pressure in the rear chamber 66 drops and the radial bore 52 is cut off from compressed air from the air flow path 36 and the air channel 77. Compressed air then flows from the air flow path 36 into the front chamber 74 via the air channel 77. Compressed air thus moves the piston 50 in a rearward direction to start another cycle of noise making operation. Therefore by pressing the button 20 continuously, the piston 50 will be actuated to move reciprocally within the cylinder 70 to hit the impact member 60 to generate audible alarm noise desired. As noise is produced by mechanical impact force and means, this invention may be used equally well in the air or in the water.

It is noted that following illustrated embodiments have in general similar structure like the one shown in FIG. 1. Therefore same numerals are used for similar type of elements.

Figure 4:
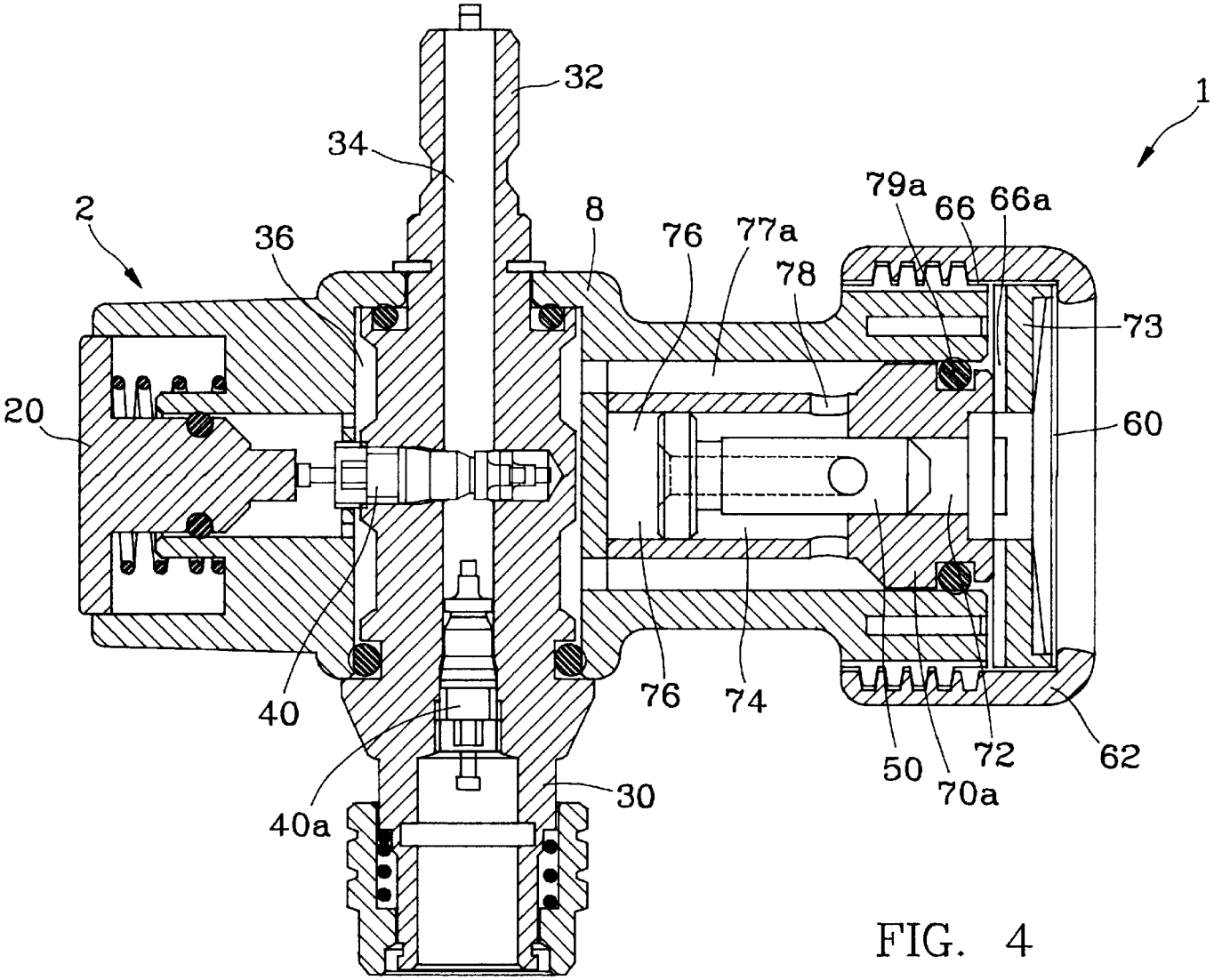
FIG. 4 is a sectional view of another embodiment of this invention.

FIG. 4 illustrates another embodiment of this invention. It is generally structured like the one shown in FIG. 1 except that an air channel 77*a* is formed by a space gap between the cylinder 70*a* and the inside surface of the body 8. A plural number of openings 78 are formed in the wall of the cylinder 77*a* to allow compressed air to flow into the front chamber 74 via the air channel 77*a*. The cylinder structure is thus more simpler. Furthermore there is a third O-ring 79*a* located at the front end of the cylinder 70*a* to prevent air leakage. There is also a padding member 73 between the impact member 60 and the front end of the cylinder 70*a*. Between the padding member 73 and the front end of the cylinder 70*a*, there is a plural number of air passages 66*a* to lead discharged air to exit via the gap 66.

Many the embodiment alterations may be made based on above disclosures. Such as an air venting opening (not shown in the drawings) may be provided in the cap 62 for discharging exit air rather than via the gap 66. The impact member 60 may be made of metal sheet or other desirable materials. The front end of the cap 62 may be made in a horn bell shape so that more effective sound producing result can be achieved when use in the air.

It may thus be seen that the objects of the present invention set forth herein, as well as those made apparent from the foregoing description, are efficiently attained. While the preferred embodiment of the invention has been set for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

I claim:

1. An amphibious audible alarm device for use with a compressed air tank to produce an audible alarm, comprising;

a valve means connected to the air tank for controlling air flow;

a noise making means including a cylinder, a piston reciprocally movable within the cylinder, and an impact member contactable with one end of the piston, said noise making means being capable of receiving said air flow controlled by said valve means to drive said piston to move reciprocally within the cylinder to hit said impact member reciprocally for generating audible sound; and a body for housing the valve means and the noise making means;

wherein the valve means includes a button, a valve and a stem, which has one end engaged with the air tank via a connector, the stem further having an internal axial passage and a peripheral air flow path around the outside surface of the stem, the peripheral air flow path is constructed such that when the button is pressed, compressed air flows from the air tank to the peripheral air flow path via the valve and the internal axial passage;

further wherein the piston is a T-shape member having a radial through bore formed in a front section, and an axial bore formed between the radial bore and a rear end thereof, and the cylinder, which houses the piston therein, has an air channel formed therein for communicating with the peripheral air flow path to receive compressed air into the cylinder for moving the piston reciprocally.

2. The amphibious audible alarm device of claim 1 further having a cap screwed at a front end of the body, the cap holding the impact member therein and having a gap formed between the cap and the body for discharging air from the cylinder.

3. The amphibious audible alarm device of claim 1, further having a fluid passage formed between the button and the valve for fluidly communicating with the peripheral air flow path to allow compressed air to flow from the internal axial passage to the peripheral air flow path when the button is pressed by am external force, the button having a resilient means disposed therein for keeping the valve at a closed position when the external force is absent.

4. The amphibious audible alarm device of claim 1, further having a first O-ring disposed between the button and the body for avoiding compressed air leakage.

5. The amphibious audible alarm device of claim 1, further having a second O-ring disposed between the stem and the body for avoiding compressed air leakage.

6. The amphibious audible alarm device of claim 1, further having a third O-ring disposed between the cylinder and the body for avoiding compressed air leakage.

7. The amphibious audible alarm device of claim 1, wherein the connector is a quick connector.

8. The amphibious audible alarm device of claim 1, wherein the cylinder is formed with an air discharging chamber at a front end, a front chamber in front the T-shape member and a rear chamber in a rear portion behind the T-shape member; wherein compressed air is flowable from the air channel to the rear chamber via the radial through bore and the axial bore thus moving the piston in a foreward direction to hit the impact member to produce audible sound; wherein when the piston is located at the front end of the cylinder, compressed air is flowable in the front chamber via the air channel to move the piston in a rearward direction.

9. An amphibious audible alarm device for use with a compressed air tank to produce an audible alarm above or below water surface, comprising;

a tabular stem with an internal axial passage having one end engaged with a connector for connecting with the air tank and a peripheral air flow path around the outside surface of the stem;

a valve located in the stem for controlling compressed air flow from the internal axial passage to the peripheral air flow path;

a button located at one end of the valve for actuating the valve to start or stop compressed air flow;

a piston formed in a T-shape member having a radial through bore in a front portion thereof and an internal axial bore formed between the radial bore and a rear end thereof;

a cylinder having a cavity to house the piston therein and an air channel fluidly communicating with the peripheral air flow path to receive compressed air from the internal axial passage of the stem, the piston being reciprocally movable within the cylinder resulting from compressed air;

an impact member secured at a front end of the cylinder by a cap; and a body for housing the stem, valve, button, piston and cylinder, the cap being screwed to the body with a gap formed therebetween for discharging used compressed air;

wherein upon pressing the button, compressed air moves the piston reciprocally and hits the impact member to produce audible alarm sound.

* * * * *